US005501456A

United States Patent [19]

Collins et al.

[11] Patent Number: 5,501,456

[45] Date of Patent: Mar. 26, 1996

[54] CHILDREN'S SPORTS TRIVIA GAME

[76] Inventors: Alex C. Collins; Margaret M. Collins, both of 3925 W. 31st St., St. Louis Park, Minn.

[21] Appl. No.: 391,780

[22] Filed: Feb. 21, 1995

[51] Int. Cl.[6] ..... A63F 7/06

[52] U.S. Cl. ..... 273/94; 273/430; 273/259

[58] Field of Search ..... 273/429, 430, 273/431, 94, 242, 247, 244, 259; 434/129, 251

[56] References Cited

U.S. PATENT DOCUMENTS

| | | | |
|---|---|---|---|
| 543,463 | 7/1895 | Brown | 273/94 R |
| 563,767 | 7/1896 | Holland | 273/94 R |
| 593,512 | 11/1897 | Cahalane | 273/94 R |
| 787,792 | 4/1905 | Riley | 273/94 R |
| 799,848 | 9/1905 | Heisman | 273/94 R |
| 1,138,678 | 5/1915 | McNair | 273/94 R |
| 1,537,648 | 5/1925 | McCarron | 273/94 R |
| 1,552,630 | 9/1925 | Michaelian | 273/94 R |
| 1,614,881 | 1/1927 | Conley | 273/94 R |
| 1,671,465 | 5/1928 | Browning | 273/94 R |
| 2,039,332 | 5/1936 | Morrill | 273/94 R |
| 4,856,780 | 8/1989 | Begley | 273/244 |
| 4,955,618 | 9/1990 | Growall | 273/244 |
| 5,087,051 | 2/1992 | Lobue | 273/431 |

*Primary Examiner*—Sebastiano Passaniti

[57] ABSTRACT

A children's sports trivia game comprised of a game board having a width and a length with a starting end and a finishing end. Yard lines, each of five yards, extend across the width of the board between the end zones. The game board has 23 peg holes extending in each of two rows from within the starting end to within the finishing end. The game board has indicia thereon replicating a football field including yard lines. The peg holes are spaced along the yard lines with one of the holes positioned within the starting end and one of the holes positioned within the finishing end. A field goal range is marked by indicia extending from adjacent to the finishing end and a location prior to the midpoint of the length of the board. The game includes a plurality of playing pieces, a plurality of sports trivia cards and answer cards, and a rule book.

6 Claims, 3 Drawing Sheets

CHILDREN' S SPORTS TRIVIA GAME

BACKGROUND OF THE INVENTION

1. Field of the Invention

The present invention relates to a children's sports trivia game and more particularly pertains to providing challenging play action through the use of a question and answer format with a children's sports trivia game.

2. Description of the Prior Art

The use of sports games is known in the prior art. More specifically, sports games heretofore devised and utilized for the purpose of learning sports trivia are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,186,467 to Chasin discloses a sports game.

U.S. Pat. No. 4,919,618 to Anderson discloses a game board with player figures for teaching team sports.

U.S. Pat. No. 4,856,780 to Begley et al. discloses a sports trivia board game.

U.S. Pat. No. 4,592,555 to Bradford discloses a sports game.

U.S. Pat. No. 4,346,899 to Nuebling, Sr. discloses a board game featuring olympic sports.

U.S. Pat. No. 4,010,957 to Tricoli discloses a sports game board.

While these devices fulfill their respective, particular objective and requirements, the aforementioned patents do not describe a children's sports trivia game for providing challenging play action through the use of a question and answer format.

In this respect, the children's sports trivia game according to the present invention substantially departs from the conventional concepts and designs of the prior art, and in doing so provides an apparatus primarily developed for the purpose of providing challenging play action through the use of a question and answer format.

Therefore, it can be appreciated that there exists a continuing need for new and improved children's sports trivia game which can be used for providing challenging play action through the use of a question and answer format. In this regard, the present invention substantially fulfills this need.

SUMMARY OF THE INVENTION

In the view of the foregoing disadvantages inherent in the known types of sports games now present in the prior art, the present invention provides an improved children's sports trivia game. As such, the general purpose of the present invention, which will be described subsequently in greater detail, is to provide a new and improved children's sports trivia game and method which has all the advantages of the prior art and none of the disadvantages.

To attain this, the present invention essentially comprises a game board having a width and a length with a starting end and a finishing end. Yard lines extend across the width of the board between the end zones and are located each of five yards. The game board has 23 peg holes extending in each of two rows from within the starting end to within the finishing end. The game board has indicia thereon replicating a football field including yard lines. The peg holes are spaced along the yard lines with one of the holes positioned within the starting end and one of the holes positioned within the finishing end. The rows of peg holes are spaced across the width of the board with between about 60 to 65 percent of the width of the board between the rows of peg holes and with between about 18 and 20 percent of the width of the board between each row of peg holes and the adjacent edge. The game board has four rubber foot pads secured to a lower surface thereof. A field goal range is marked on the board by indicia extending from adjacent to the finishing end and a location prior to the midpoint of the length of the board. The game includes two playing pieces. Each of the playing pieces replicates a foot ball player. Each of the two playing pieces has a pegged lower end. Each pegged lower end is adapted to be received within the plurality of peg holes of the game board. The game includes a plurality of sports trivia cards and answer cards. The game also includes a rule book.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved children's sports trivia game which has all the advantages of the prior art sports games and none of the disadvantages.

It is another object of the present invention to provide a new and improved children's sports trivia game which may be easily and efficiently manufactured and marketed.

It is a further object of the present invention to provide a new and improved children's sports trivia game which is of durable and reliable construction.

An even further object of the present invention is to provide a new and improved children's sports trivia game which is susceptible of a low cost of manufacture with regard to both materials and labor, and which accordingly is then susceptible of low prices of sale to the consuming public, thereby making such a children's sports trivia game economically available to the buying public.

Still yet another object of the present invention is to provide a new and improved children's sports trivia game which provides in the apparatuses and methods of the prior art some of the advantages thereof, while simultaneously overcoming some of the disadvantages normally associated therewith.

Even still another object of the present invention is to provide a new and improved children's sports trivia game for providing challenging play action through the use of a question and answer format.

Lastly, it is an object of the present invention to provide a new and improved children's sports trivia game comprised of a game board having a width and a length with a starting end and a finishing end. Yard lines, each of five yards, extend across the width of the board between the end zones. The game board has 23 peg holes extending in each of two rows from within the starting end to within the finishing end. The game board has indicia thereon replicating a football field including yard lines. The peg holes are spaced along the yard lines with one of the holes positioned within the starting end and one of the holes positioned within the finishing end. A field goal range is marked by indicia extending from adjacent to the finishing end and a location prior to the midpoint of the length of the board. The game includes a plurality of playing pieces, a plurality of sports trivia cards and answer cards, and a rule book.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
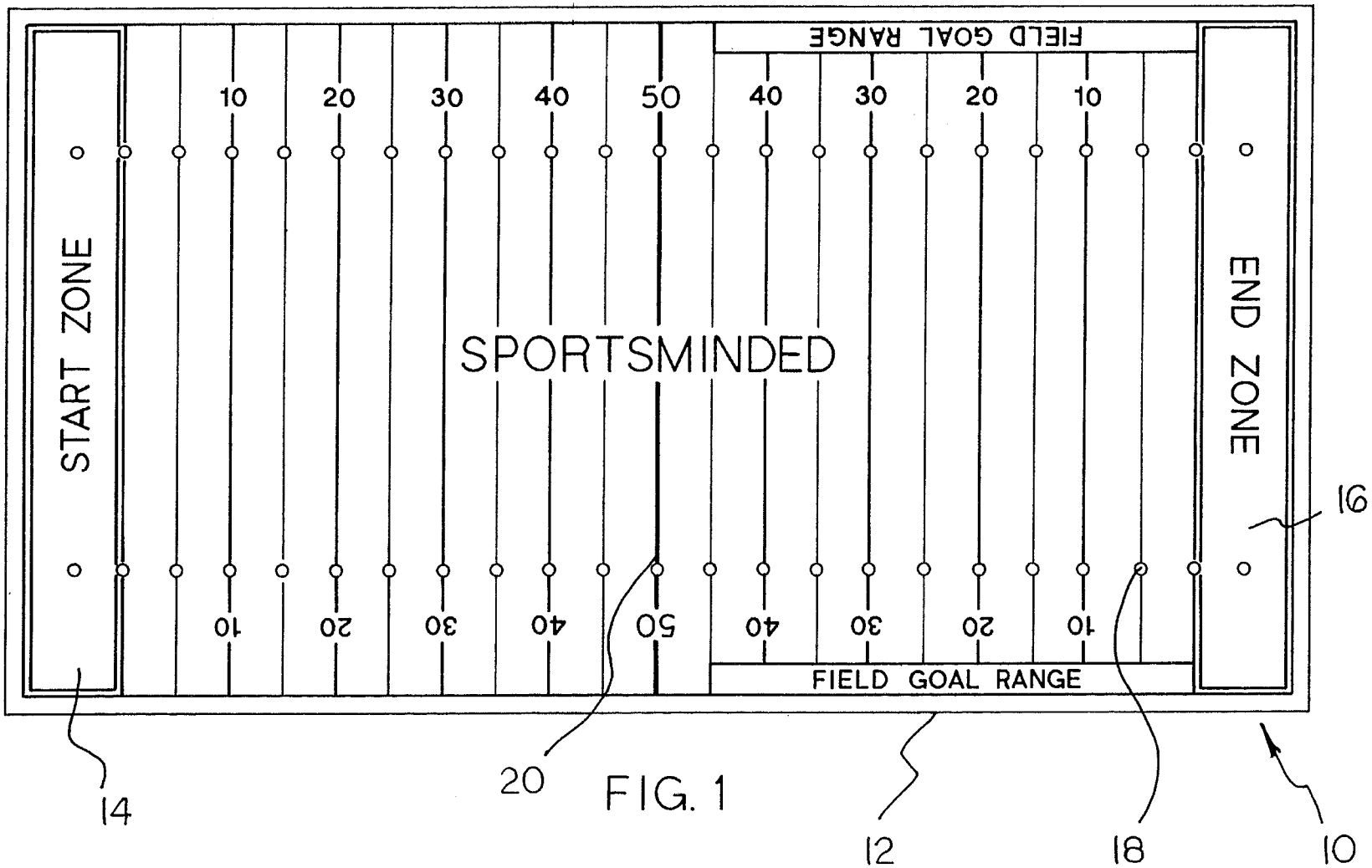
FIG. 1 is a perspective view of the preferred embodiment of the children's sports trivia game constructed in accordance with the principles of the present invention.
Figure 2:
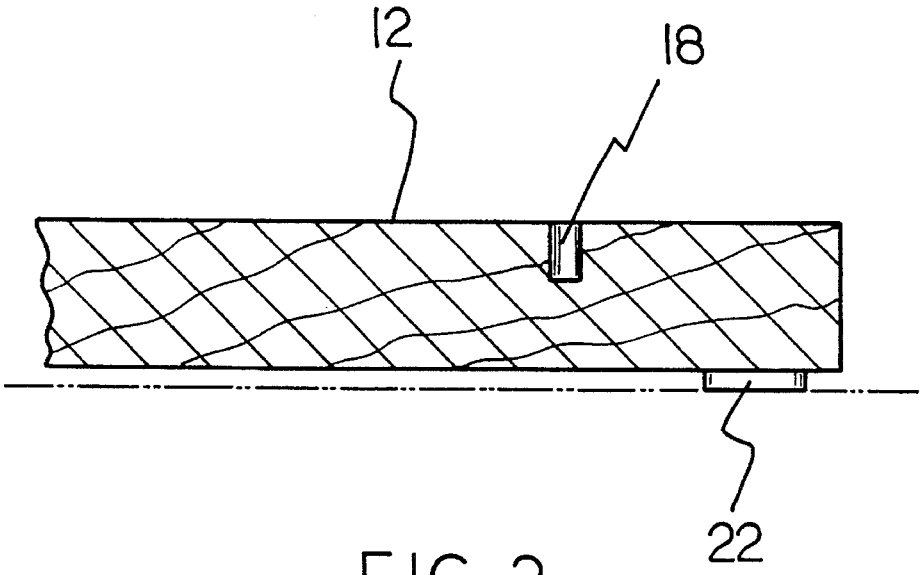
FIG. 2 is a fragmentary elevation view of the peg holes of the game board.
Figure 3:
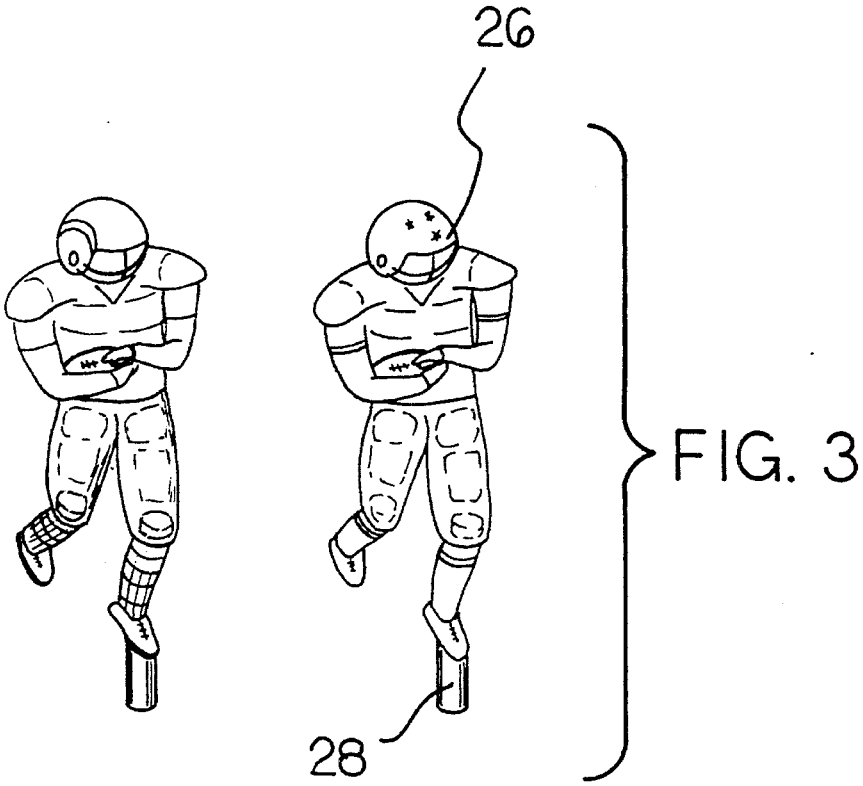
FIG. 3 is a front elevation view of the playing pieces of the present invention.
Figure 4:
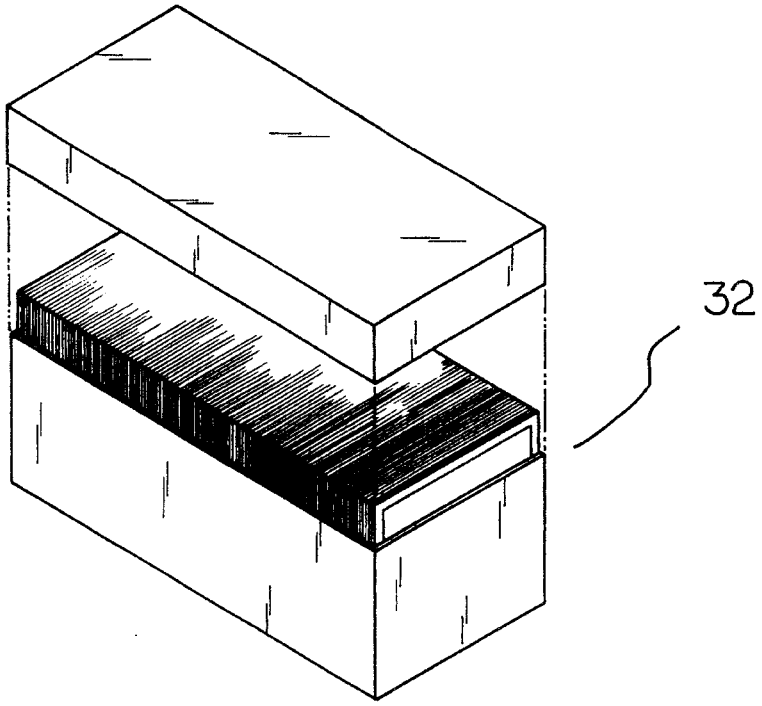
FIG. 4 is a perspective view of the accompanying question and answer cards.
Figure 5:
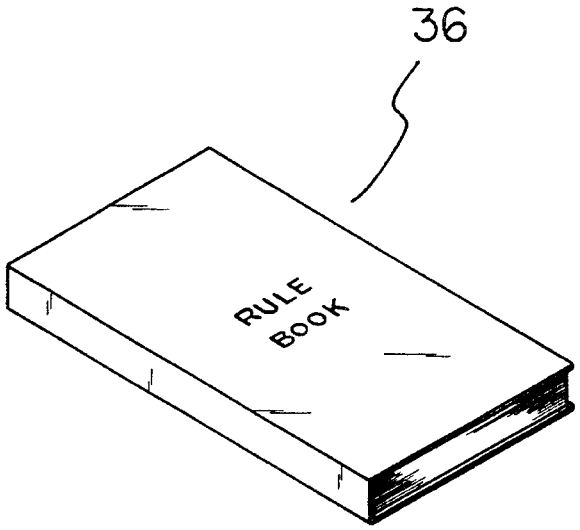
FIG. 5 is a perspective view of the accompany rule book of the present invention.

With reference now to the drawings, and in particular to FIG. 1 thereof, the preferred embodiment of the new and improved children's sports trivia game embodying the principles and concepts of the present invention and generally designated by the reference number 10 will be described.

Specifically, it will be noted in the various Figures that the device relates to a new and improved children's sports trivia game for providing challenging play action through the use of a question and answer format. In its broadest context, the device consists of a game board, two playing pieces, sports trivia cards and answer cards, and a rule book.

The device 10 includes a game board 12 having a starting end 14, a starting end zone, a finishing end 16, and a finishing end zone. Yard lines extend across the width of the board between the end zones and are located each five yards. The game board 12 has a plurality of peg holes 18, preferably 23, extending in two rows from within the starting end 14 to within the finishing end 16. The starting end 14 is labeled as the start zone. The finishing end 16 is labeled as the end zone. The game board. 12 has indicia thereon replicating a football field including yard lines 20. The plurality of peg holes 18 are spaced along the yard lines 20 with one of the plurality of holes 18 positioned within the starting end 14 and one of the plurality of holes 18 positioned within the finishing end 16. The rows of peg holes are spaced across the width of the board from each other with between about 60 to 65 percent of the width of the board, preferably 62 percent, located between the rows of peg holes. As a result, between about 18 and 20 percent, preferably 19 percent, of the width of the board is between each row of peg holes and the adjacent edge. The game board 12 has four rubber foot pads 22 secured to a lower surface thereof.

Next provided is a field goal range marked by indicia 25 extending from adjacent to the finishing end and a location prior to the midpoint of the length of the board.

The game includes two playing pieces 26. Each of the playing pieces 26 replicates a foot ball player. Each of the two playing pieces 26 has a pegged lower end 28. Each pegged lower end 28 is adapted to be received within the plurality of peg holes 18 of the game board 12.

The game includes a plurality of sports trivia cards and answer cards 32.

The game also includes a rule book 36. The rule book would include as follows: Players begin by placing their playing pieces in the start zone. Two to four people or teams can play. Players take turns asking each other questions. If a general question is answered correctly, the player or team moves one peg. A bonus question (on the same card) is then asked. If answered correctly, that same player or team can move down field another one peg.

To score a touchdown—and seven points—a player or team must answer questions correctly to enter the end zone for a total of twenty correct questions. When a player or team scores a touchdown, he/she goes back to the start zone.

A player or team can attempt a field goal from inside the fifty yard line. When the field goal range has been reached, the player or team must announce the field goal attempt prior to the reading of the first question. Both the general and bonus questions must be answered correctly to receive the three points. If a field goal is scored, the player then goes back to the start zone.

The player with the most points after thirty to sixty minutes of play wins the game.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A children's sports trivia game for providing challenging play action through the use of a question and answer format comprising, in combination:

a game board having a width and a length with a starting end and a finishing end, with yard lines, each of five yards, the game board having 23 peg holes extending in each of two rows from within the starting end to within the finishing end, the game board having indicia thereon replicating a football field including yard lines, the peg holes spaced along the yard lines with one of the holes positioned within the starting end and one of the holes positioned within the finishing end, the rows of peg holes being spaced across the width of the board with between about 60 to 65 percent of the width of the board between the rows of peg holes and with between about 18 to 20 percent of the width of the board between each row of peg holes and the adjacent edge, the game board having four rubber foot pads secured to a lower surface thereof;

a field goal range marked by indicia extending from adjacent to the finishing end and a location prior to the midpoint of the length of the board;

two playing pieces, each of the playing pieces replicating a football player, each of the two playing pieces having a pegged lower end, each pegged lower end adapted to be received within the plurality of peg holes of the game board;

a plurality of sports trivia cards and answer cards; and a rule book, whereby said sports trivia cards and said answer cards are used in combination with said rule book to determine the movement of said playing pieces in said pegged holes along said game board.

2. A children's sports trivia game for providing challenging play action through the use of a question and answer format comprising, in combination:

a game board having a width and a length with a starting end and a finishing end, with yard lines, each of five yards, the game board having 23 peg holes extending in each of two rows from within the starting end to within the finishing end, the game board having indicia thereon replicating a football field including yard lines, the peg holes spaced along the yard lines with one of the holes positioned within the starting end and one of the holes positioned within the finishing end, the rows of peg holes being spaced across the width of the board with between about 60 to 65 percent of the width of the board between the rows of peg holes and with between about 18 to 20 percent of the width of the board between each row of peg holes and the adjacent edge, the game board having four rubber foot pads secured to a lower surface thereof;

a field goal range marked by indicia extending from adjacent to the finishing end and a location prior to the midpoint of the length of the board;

a plurality of playing pieces;

a plurality of sports trivia cards and answer cards; and a rule book, whereby said sports trivia cards and said answer cards are used in combination with said rule book to determine the movement of said playing pieces in said pegged holes along said game board.

3. The game as described in claim 1 and further including wherein the starting end is labeled the start zone on the game board.

4. The game as described in claim 3 and further including wherein the finishing end is labeled the end zone on the game board.

5. The game as described in claim 2 and further including wherein the plurality of playing pieces replicating a football player, each of the plurality of playing pieces having a pegged lower end, each pegged lower end adapted to be received within the plurality of peg holes of the game board.

6. The game as described in claim 2 and further including wherein the number of rows on the game board is two.

* * * * *